US008418536B2

(12) United States Patent
Miyamae

(10) Patent No.: US 8,418,536 B2
(45) Date of Patent: Apr. 16, 2013

(54) GOLF CLUB TESTING MACHINE

(75) Inventor: Toshiaki Miyamae, Osaka (JP)

(73) Assignee: Miyamae Co., Ltd. (JP)

( * ) Notice: Subject to any disclaimer, the term of this patent is extended or adjusted under 35 U.S.C. 154(b) by 307 days.

(21) Appl. No.: 12/884,534

(22) Filed: Sep. 17, 2010

(65) Prior Publication Data

US 2011/0067507 A1 Mar. 24, 2011

(30) Foreign Application Priority Data

Sep. 18, 2009 (JP) ..... 2009-217376
Jun. 4, 2010 (JP) ..... 2010-128792

(51) Int. Cl.
*A63B 53/00* (2006.01)

(52) U.S. Cl.
USPC ..... 73/65.03

(58) Field of Classification Search ..... 73/65.03, 73/65.01, 65.07
See application file for complete search history.

(56) References Cited

U.S. PATENT DOCUMENTS 3,855,842 A * 12/1974 Imabori et al. ..... 73/11.01
4,996,867 A * 3/1991 Miyamae ..... 73/11.01
5,472,205 A * 12/1995 Bouton ..... 473/222
5,826,874 A * 10/1998 Teitell et al. ..... 473/225
5,908,979 A * 6/1999 Miyamae ..... 73/12.14
6,571,640 B2 * 6/2003 Harrison ..... 73/800
7,849,725 B1 * 12/2010 Nelson et al. ..... 73/12.05
8,033,928 B2 * 10/2011 Cage ..... 473/324

FOREIGN PATENT DOCUMENTS

| | | |
|---|---|---|
| JP | 08-280852 | 10/1996 |
| JP | 09-149958 | 6/1997 |
| JP | 11-169501 | 6/1999 |
| JP | 2001-029516 | 2/2001 |
| JP | 2007-073003 | 3/2007 |

* cited by examiner

*Primary Examiner* — Max Noori
(74) *Attorney, Agent, or Firm* — Thompson Hine L.L.P.

(57) ABSTRACT

A golf club testing machine includes a swing arm mechanism, an upper section supporting the swing arm mechanism, a barrel section supporting the upper section in a manner such that the upper section is adjustable at a forwardly inclined angle, a base section supporting the barrel section in a manner such that the barrel section is rotatable in a horizontal plane at a constant height, and a hit assisting mechanism rotating the barrel section in a horizontal plane in unison with the swing arm mechanism.

10 Claims, 9 Drawing Sheets

GOLF CLUB TESTING MACHINE

TECHNICAL FIELD

The present invention relates to a golf club testing machine for mechanically performing a test swing to test performance of a golf club.

BACKGROUND ART

In the development and manufacture of a golf club, performance testing is made by simulation-analyzing a test swing with a computer. The test swing may be performed by persons, while as disclosed in Japanese Patent Application Nos. 07-336153 filed Nov. 29, 1995, 08-019176 filed Feb. 5, 1996, 2000-202871 filed Dec. 22, 1998 and 2005-262515 filed Sep. 9, 2005, the disclosures of which are incorporated herein by reference, a golf club testing machine (also referred to as a swing robot or a shot robot) that mechanically performs test swings has been developed.

The golf club testing machine disclosed in Japanese Application Nos. 07-336153 and 08-019176 includes a swing arm mechanism including a first arm analogous to a human arm, and a second arm analogous to a human wrist. The first arm and the second arm are rotated in unison with each other with a golf club held by the second arm. The first arm and the second arm rotate in the same direction, but are different from each other in position of axis of rotation. In terms of angle of rotation and rotational speed, the first arm and the second arm are independently controlled by different motors. The swing arm mechanism permits a variety of club trajectory patterns to be taken.

As holder means of the golf club, the golf club testing machine includes on the second arm a twisting mechanism driven by another motor. The twisting mechanism is analogous to a folding back motion of the human wrist. The golf club testing machine operates a manner more analogous to a human swing motion.

The golf club testing machine disclosed in Japanese Application No. 2000-202871 includes on a portion thereof a rotary mechanism analogous to human hips. The rotary mechanism is rotated in an oscillating drive in a reciprocating fashion in order to measure torque of the golf club.

The golf club testing machine, developed by the inventor of this invention and disclosed in Application No. 2005-262515, includes a hit assisting mechanism simulating a sway of the hips of a player, in addition to the swing arm mechanism of Application Nos. 07-336153 and 08-019176.

Japanese Patent Application No. 09-362686 filed Dec. 12, 1997, the disclosure of which is incorporated herein by reference, discloses a club holder structure of a golf club testing machine. The holder structure includes a pair of clamping members forming a barrel-like groove. With the clamping members engaged with each other, the barrel-like groove forms a through-hole having a shape similar to the outer shape of the grip of the golf club. If the end of the grip is inserted with the grip in the through-hole, the outer surface of the grip is pressed into contact with the through-hole, and the grip is held.

SUMMARY OF THE INVENTION

Technical Problem

One of the performance requirements of the golf club is a flying distance. An increase in the flying distance is an important development factor, particularly, in view of a driver in a driving shot. In the case of a human player, the flying distance may be adjusted by the swing of arms and the sway of the hips. The golf club testing machines disclosed in Application Nos. 07-336153 and 08-019176 have no rotary portion analogous to the sway of the hips, and thus adjust the flying distance only by the operation of the swing arm mechanism. More specifically, the rotational speed of the swing arm mechanism is adjusted by adjusting the output of a motor to control the flying distance. To increase the flying distance, a high-powered motor is needed. The high-powered motor is heavy. If the center of gravity of an entire device is appropriately balanced, the resulting apparatus becomes inevitably large.

Mere amplification of the output of the motor of the swing arm mechanism is not sufficient to maximize the flying distance performance of the golf club. To increase the flying distance, not only the initial speed of a golf ball is increased, but also appropriate spinning is imparted to the golf ball. Human players impart appropriate spinning to the golf ball by swaying their hips.

The golf club testing machine disclosed in Application No. 2000-202871 swings a golf club only by rotating a barrel section. The golf club testing machine cannot maximize the flying distance performance of the golf club.

The golf club testing machine disclosed in Application No. 2005-262515, including the swing arm mechanism of Application Nos. 07-336153 and 08-019176 and the barrel rotary mechanism of Application No. 2000-202871, maximizes the flying distance performance, thereby resulting in an ideal swing.

The machine disclosed in Application No. 2005-262515 has also a problem to be solved. The machine includes a hit assisting mechanism on a base foot section. The hit assisting mechanism rotates in a horizontal plane a base section immediately thereabove. The base section supports a lower barrel section in a manner such that the lower barrel section is height-adjustable. The lower barrel section supports an upper section in a manner that allows the upper section to be adjustable in a forwardly inclined angle. The swing arm mechanism is arranged on the upper section. The hit assisting mechanism horizontally rotates all the mechanisms above the base section in unison with the swing arm mechanism. During a test swing, a relatively high load is applied to the hit assisting mechanism, thereby adversely affecting stability of the hit assisting mechanism.

Another object of the golf club testing machine including the swing arm mechanism is to increase the efficiency of the test swing. The golf club testing machine having the swing arm mechanism has an angle of rotation of about 200 degrees from an address position to a follow-through position thereof. In the case of a full swing, the angle of rotation becomes 230 degrees or more. For a next swing operation, a known golf club testing machine causes the motor to rotate in a direction opposite to the swing direction, thereby returning the swing arm mechanism from the follow-through position to the address position. It takes time to cause the swing arm mechanism to revert to the address position.

Another challenge is that the golf club testing machine needs to hold the golf club correctly. When a human player grasps a golf club, the player adjusts appropriately the positions of the hands, and the fingers, and the bending and gripping force of the fingers. But it is difficult to require that the golf club testing machine practice such a complex human manner of gripping. However, the development of the golf club testing machines has been recently so much in progress that a swing motion closer to that of a human becomes possible. In view of this, the holding position of the golf club is preferably closer to the human manner of grasping.

The holder structure disclosed in Application No. 09-362686 is largely different from the human manner of grasping in the points described below. In a first different point, a human player holds the grip of the golf club at two locations, upper and lower points, with both hands while the device disclosed in Application No. 09-362686 holds entirely or at one location the grip with a pair of holder members that are to engage with each other. In a next different point, the human player adjusts grasping force by each hand, each finger, and each thumb, while the device disclosed in Application No. 09-362686 grasps uniformly the external surface of the grip. In the case of the human player, localized deformation and stress concentration may take place on the grip during the swing while Application No. 09-362686 states that neither localized deformation nor stress concentration takes place on the device. Even a golf club testing machine performing a swing closest possible to that of a human player, and having the holder structure of Application No. 09-362686 may generate deformation and stress different from those caused by the human manner of grasping. As a result, there is a possibility that the device of Application No. 09-362686 fails to evaluate the performance of a golf club and a grip thereof designed on the premise that the golf club is used by a human player.

The objects of the present invention is to solve the plurality of problems described above. More specifically, a first object of the present invention is to perform stably a hip turning motion for increasing the flying distance. A second object is to shorten the returning time from the follow-through position to the address position. A third object is to make the holding manner of the grip of the golf club closer to the human holding manner.

Solution to Problem

To accomplish the first object, the present invention includes a swing arm mechanism. The swing arm mechanism includes a first arm controllably rotated by a servomotor and a second arm controllably rotated by a motor different from the servomotor. The first arm, analogous to a human upper arm, functions as a main arm of the swing arm mechanism. The second arm, analogous to a human hand or a human forearm, functions as an arm driven by the first arm. The swing arm mechanism is supported by an upper section analogous to a human chest. The upper section is supported by a barrel section analogous to a human torso in a manner such that the upper section is adjustable in a forward inclination angle. The barrel section is rotated in a horizontal plane in unison with the swing arm mechanism by a hit assisting mechanism. A horizontal turn of the barrel section is analogous to a human hip turn motion. The golf club testing machine of the present invention imparts, to a golf ball, spinning that cannot be obtained by the swing arm mechanism alone, and increases a flying distance of the golf ball.

The hit assisting mechanism preferably includes a main gear integrally arranged with the barrel section, a second servomotor different from the swing arm mechanism, and a transfer gear connecting the second servomotor to the main gear. With this arrangement, the main gear on the barrel section serves as a reference position of a horizontal rotation (hip turning). The center of gravity of the device is not too high and not too low in height, and a stable test swing can be made.

To accomplish the second object of the present invention, the first arm of the swing arm mechanism is rotated by one turn in a normal direction to revert to the address position from the follow-through position while the second arm and the hit assisting mechanism are rotated in a reciprocating fashion. This arrangement reduces the time for the first arm to return to the address position.

To accomplish the third object, the holder structure of the present invention includes a first chuck and a second chuck respectively arranged at two locations along the longitudinal direction of a cylindrical body. The cylindrical body includes at the center thereof an insertion hole receiving the grip, and external screws on the circumference of the cylindrical body on the entry side and the rear side of the insertion hole. The inner circumference of the insertion hole on the entry side forms a hole tapered to the rear end of the insertion hole. A plurality of slits are arranged on the circumference of the rear end portion of the cylindrical body and communicates with the insertion hole.

The first chuck includes a plurality of split collet members to be inserted into the tapered hole, and a cap nut to be screwed around the external screw portion on the entry side. Each of the collet members has an external tapered curved surface at the same inclination as the inclination of the tapered hole. The collet members have inner arc surfaces to be engaged with the external surface of the grip. The grip with the collet members fitted around is inserted into the insertion hole of the cylindrical body, and the nut is tightened. A wedging effect of the collet members secures and holds the grip.

The second chuck includes a jaw member pivotally supported to within the slit, and a nut screwed around the external screw on the rear side. The jaw member includes an internal toothed surface and a slope surface, projected out of the slit, as an external surface opposite the internal toothed surface and having a rising slop toward the rear end. The second chuck presses the jaw member with the nut tightened, and thus holds the grip.

The holder structure of the present invention holds the grip at the two locations with the first chuck and the second chuck. This holding manner is close to the human holding manner in which the human players holds the grip at the two locations with the right and left hands. The first chuck and the second chuck are different from each other in a pressing surface area with the grip and pressing force. The manner of holding the grip is also similar to the human holding manner in which the human player adjusts the force applied by the right and left hands and the fingers.

The cap nut and the nut have hex key wrench holes on the circumferences thereof. This arrangement is intended to secure more tightly the grip not only by manually tightening the cap nut and the nut in the last step but also by further using the hex key wrench for even tighter grasping. With the hex key wrench tightening the grip, the collet members are deeply inserted into the tapered hole of the cylindrical body in the first chuck. The grasping force to the jaw member is increased in the second chuck. The grip is thus engaged with each of the chucks reliably and securely.

If the tightening of the grip is performed using the hex key wrench in the last step, the collet member cannot be pulled out of the tapered hole even with the cap nut loosened. This is because the collet member is tightly held between the grip and the tapered hole. In accordance with the present invention, a through-hole different from the key hole and penetrating through the circumference of the cap nut to a female screw hole is arranged. A ring groove is arranged on the external surface of the collet member and receives the end of the hex key wrench at a position where the ring groove meets the through-hole.

With this arrangement, the hex key wrench is inserted through the through-hole of the cap nut and engaged with the ring groove of the collet member. With the cap nut loosened, the collet member is pulled together. Even if an amount of loosening is small, the collet member is released from the tightened state thereof.

The collet member has a structure of a cylindrical socket split into a plurality of arc sections. The number of splits is optional. Two splits is preferable. The smaller the number of splits is, the easier the handling of the collet members including the mounting of the collet members on the grip becomes.

The toothed surface of the jaw member is arranged to prevent slipping of the grip. Rugged wavy grooves are preferably arranged in the direction of length of the grip. The rugged portion of the rugged wavy grooves bites into the outer surface of the grip, increasing the slip prevention effect.

Advantageous Effects of the Invention

The golf club testing machine of the present invention increases the initial speed of a golf ball and imparts an appropriate spin motion to the golf ball, using the arm swing of the swing arm mechanism and the hip turning motion of the hit assisting mechanism. The maximum flying distance is increased more than that of the related art technique. Since the hit assisting mechanism rotates the barrel section via the main gear, the center of gravity of the entire device is set to be at an appropriate position, not too high and not too low in height. A reliable test swing is thus performed. Since only the first arm having a maximum angle of rotation in the test swing is rotated in the direction of swing to revert back to the address position, time from the completion of the test swing to the reversion to the address position is shortened. The number of test swings per unit time is thus increased, and the test swing is efficiently performed.

In the holder structure of the present invention, the grip of the golf club is held at two locations by the first chuck and the second chuck. The holder structure of the present invention is thus similar to the human manner of holding the grip with both hands. If the structure may be applied to the golf club testing machines designed to make a swing close to a human swing motion and disclosed in Application Nos. 07-336153, 08-019176, 2000-202871 and 2005-262515, more accurate test results are obtained. Since the tightening of the cap nut and the nut is finalized using the hex key wrench, the grip is reliably secured. Even if a tightening operation using the hex key wrench makes it difficult to pull the collet member out of the tapered hole of the cylindrical body, the hex key wrench is inserted through the wrench hole of the cap nut to loosen the collet member, and the collet member is thus easily pulled out of the tapered hole. A pair of collet members, each member being half-split, is arranged to facilitate the mounting of the collet member onto the grip. The rugged portion of the rugged wavy grooves of the toothed surface of the jaw member bites into the surface of the grip, thereby reliably preventing the grip from falling off and rotating.

DESCRIPTION OF EMBODIMENTS

Figure 1:
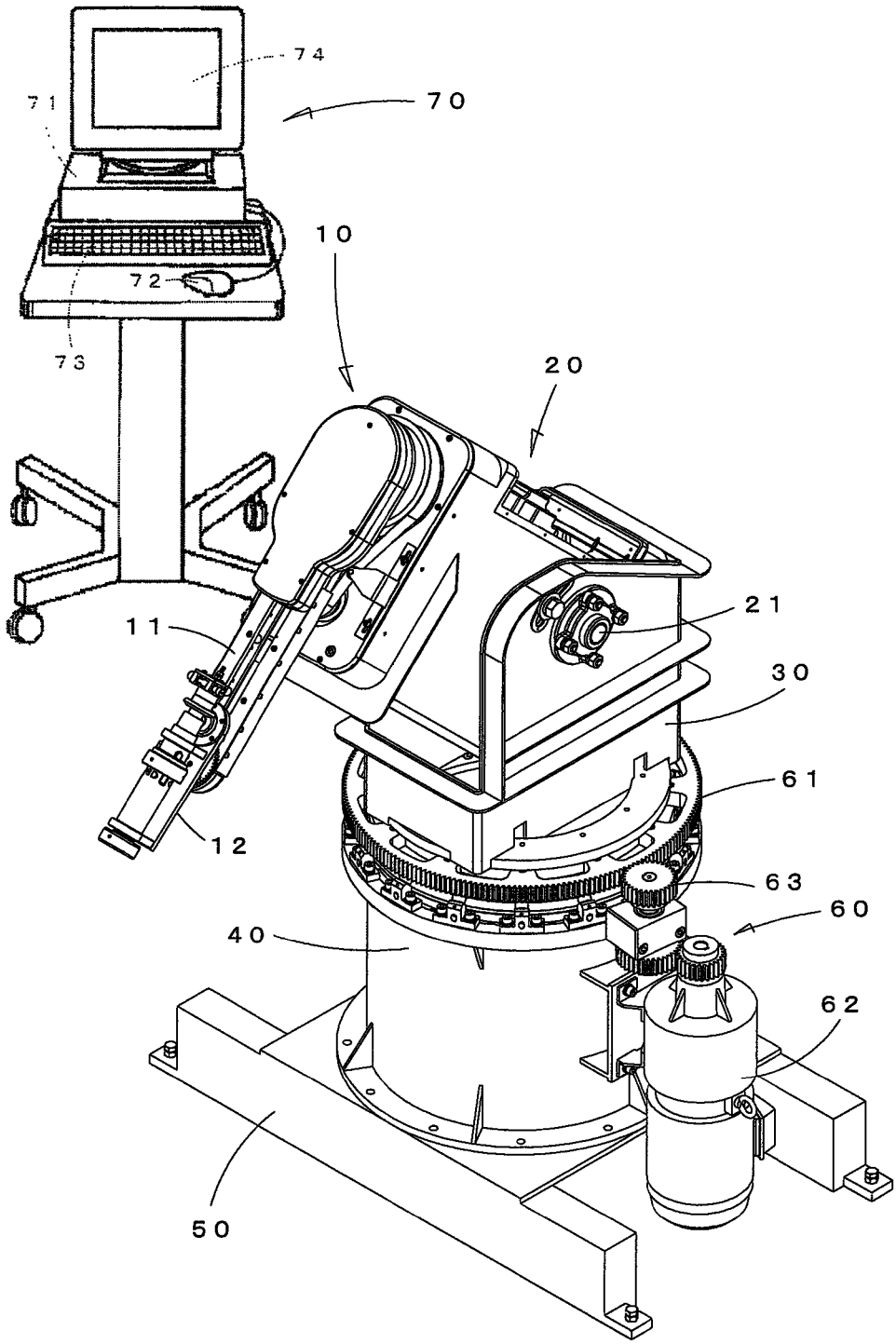
FIG. 1 is a general perspective view of a golf club testing machine of one embodiment of the present invention.

The preferred embodiments of the present invention are described below with reference to the attached drawings. FIG. 1 illustrates a golf club testing machine of one embodiment of the present invention. The golf club testing machine includes a swing arm mechanism 10 that detachably holds a golf club, an upper section 20 supporting the swing arm mechanism 10, a barrel section 30 vertically extending and supporting the upper section 20, a base section 40 vertically extending and supporting the barrel section 30, and a base foot section 50 having four end portions around the base section 40. By bolting the base foot section 50 to the ground using anchor bolts, the device is prevented from carelessly tipping over or vibrating. A hit assisting mechanism 60 is also arranged. The upper section 20 is adjustable together with the swing arm mechanism 10 in forward inclination angle thereof within a range of 30 degrees by an angle adjusting shaft 21. The angle adjusting shaft links the upper section 20 to the barrel section 30. The barrel section 30 vertically extends and is positioned together with the upper section 20 by a hydraulic lifting height adjuster within a range of from 20 to 50 cm. The angle adjustment and the height adjustment may be controlled by servomotors or hydraulic controllers.

A control unit 70 of the device includes a personal computer 71 having a predetermined program installed thereon. Input devices such as a mouse 72, and a keyboard 73 input settings of the device such as for the angle adjustment and the height adjustment. The input devices also input swing settings such as a rotational speed and an angle of rotation of each of the swing arm mechanism 10 and the hit assisting mechanism 70. A display device such as a CRT display 74 displays analysis results of a test swing. A control method and an analysis method of the test shot by the control unit 70 are disclosed in the patent application applied by the inventor of this invention Application 07-336153.

Figure 2:
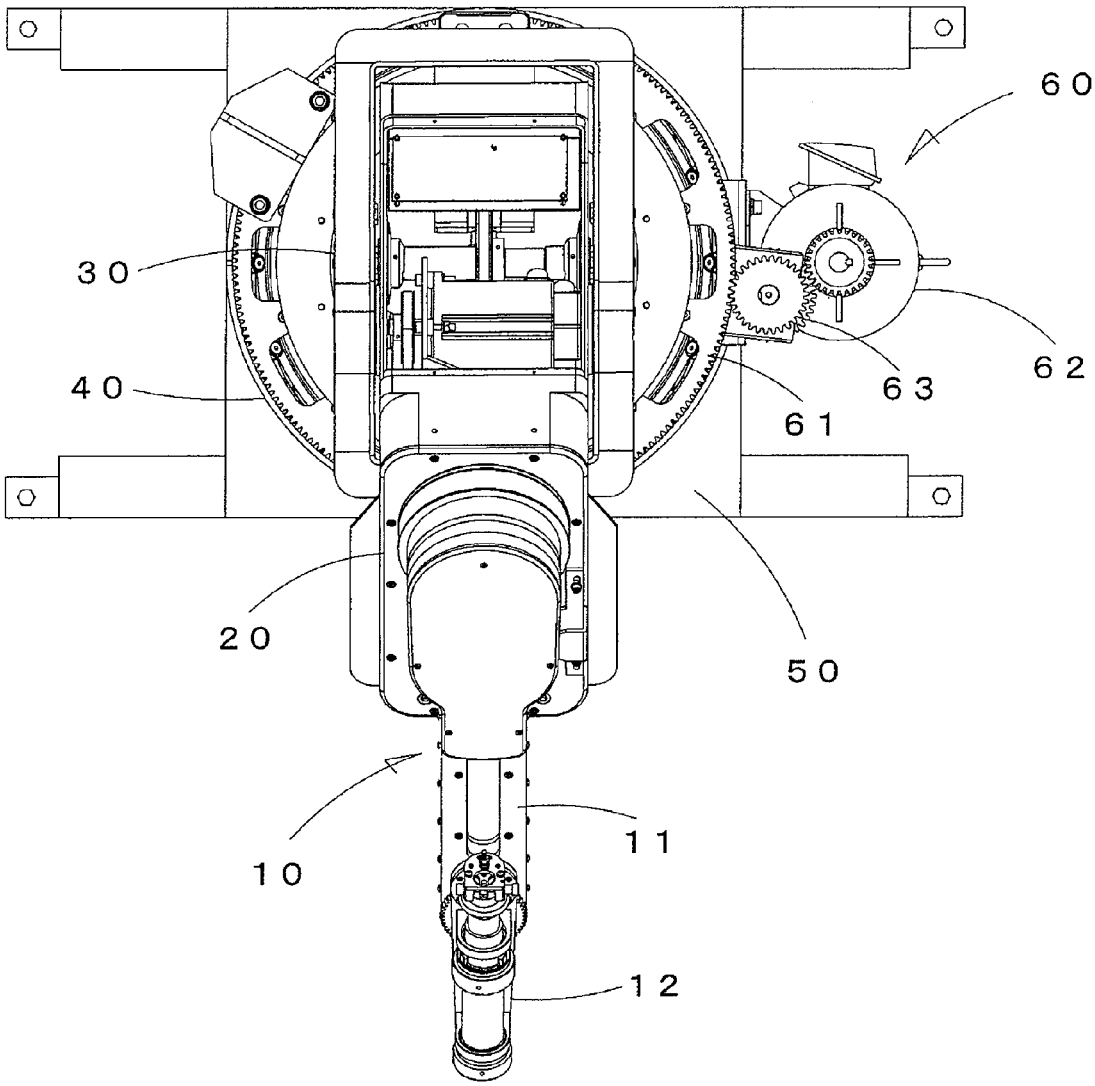
FIG. 2 is a plan view of a hit assisting mechanism of the golf club testing machine.

As illustrated in FIG. 2, the hit assisting mechanism 60 of this embodiment includes a main gear 61 integrally attached to the bottom face of the barrel section 30. The hit assisting mechanism 60 causes the base section 40 to rotatably support the barrel section 30 thereon. Arranged around the base section 40 are a servomotor 62 as a torque source, and a transfer gear 63 for speed reduction. Torque of the servomotor 62 is transferred to the main gear 61 via the transfer gear 63, and controls the barrel section 30 such that the barrel section 30 is rotated in a horizontal plane in normal and reverse directions (in a reciprocating fashion).

In the golf club testing machine, the control unit 70 controls the servomotor 62, thereby causing the hit assisting mechanism 60 to operate in unison with the swing arm mechanism 10. The golf club testing machine thus performs a test swing in response to the addition of the swing motion of the swing arm mechanism 10 and the turning motion of the hit assisting mechanism 60. The golf club testing machine can thus increase a flying distance by performing a swing analogous to a human swing motion that results from the swing of the arms and the turning motion of the hips. More specifically, the swing arm mechanism 10 (the swing motion of the arms) alone can impart a revolution of about 1800 rpm to the golf ball. In contrast, if the hit assisting mechanism 60 (the turning motion of the hips) is additionally used, the revolution of the golf ball spin rises to about 3000 rmp, and as a result, the flying distance is increased. The hit assisting mechanism 60 causes the barrel section 30 and sections above the barrel section 30 to rotate in a horizontal plane via the main gear 61 arranged on the bottom face of the barrel section 30, i.e., arranged in the middle portion of the whole device. In other words, the swing arm mechanism 10, the upper section 20, and the barrel section 30 are analogous to the upper half of the human body while the base section 40 and the base foot section 50 are analogous to the lower half of the human body. In accordance with the present invention, the main gear 61 is arranged in the middle portion of the device for the hip turning motion. The main gear 61 contributes to stabilizing the center of gravity of the device. Without the need for introducing a bulky design to the base foot section 50 and a reinforcement to each support member, a higher-quality anti-vibration effect in the test swing is increased. The hit assisting mechanism 60 can be controlled to rotate in normal and reverse directions within a range of 30 degrees with reference to the address (impact) position as 0 degree. As long as the hit assisting mechanism 60 operates within a hit assisting range of the swing arm mechanism 10, no particular limitations are set in operation timing and rotation. The rotational speed and the angle of the swing arm mechanism 10 and the barrel section driven by the hit assisting mechanism 60 are appropriately modified depending on the test purpose of the golf club to be tested.

The barrel section 30 and the base section 40 vertically extend in accordance with the present embodiment, and the angle of the motor axis in the hit assisting mechanism may be vertically aligned or horizontally aligned. However, if the motor axis is horizontally aligned, and an angle is made between the motor axis and an extending axis of the barrel section and the base section, a bevel gear may be arranged as a transfer gear. The bevel gear angle-converts the output axis of the motor so that the vertically extending barrel section or the vertically extending base section is rotated in a reciprocating fashion.

The swing arm mechanism 10 has a structure identical to the structure disclosed in Application No. 07-336153, and is briefly discussed here. The upper section 20 includes a first arm 11 and a second arm 12. The first arm 11 rotates by a range of a total of 360 degrees from zero degree at a back-swing top position to an impact (address) position to a follow-through end position, i.e., rotates one full turn. The first arm 11 axially supports at the free end thereof the second arm 12 which is rotatable within a range of a total of 180 degrees from +90 degrees to −90 degrees.

The above-described first arm 11 is analogous to a human upper arm and the second arm 12 is analogous to a human lower arm (forearm) or a human hand (wrist). A holder structure 13 is arranged on the top surface of the second arm 12. The grip of a golf club is detachably fixed to the holder structure 13.

Figure 3:
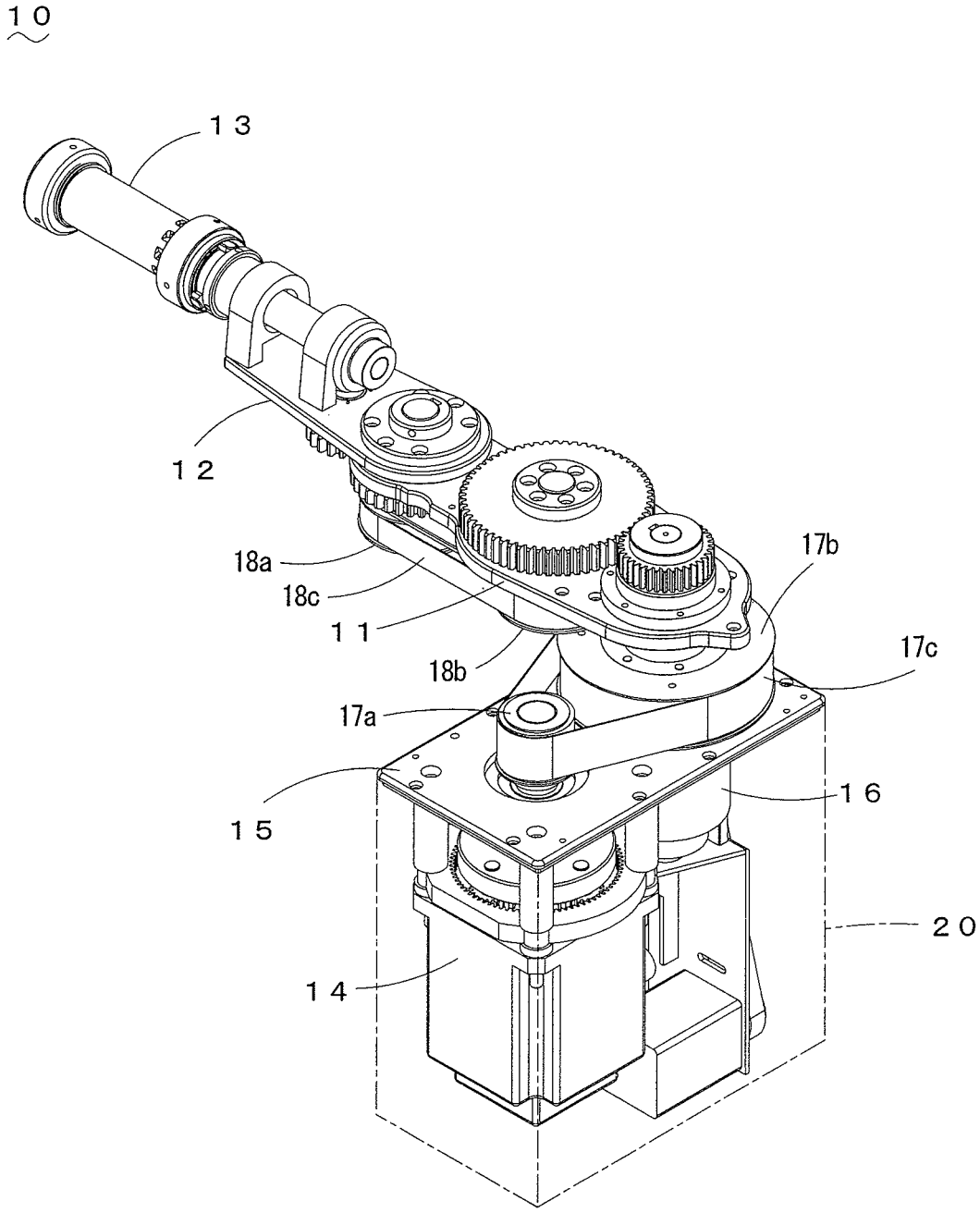
FIG. 3 is a perspective view of a swing arm mechanism of the golf club testing machine.

A structure of the first arm 11 and the second arm 12, forming two independent transfer systems, is described below with reference to FIG. 3. A first motor 14, serving as revolving means for reversible rotation and speed modification, is mounted within the above-described upper section 20. A top cover 15 is fixed onto the upper section 20. A second motor 16, serving as rotary drive means for reversible rotation and speed modification, is mounted within the upper section 20. An AC servomotor with the rotor thereof rotatable at a rotational speed proportional to a control current and in a specified direction may be used for these motors 14 and 16.

The first arm 11 and the first motor 14 are linked via a plurality of pulleys 17*a* and 17*b*, and a timing belt 17*c* and thus form a first torque transfer path. Torque of the first motor 14 is transferred to a base portion of the first arm 11 via the pulleys 17 and the timing belt 18.

Similarly, a plurality of pulleys 18*a* and 18*b* and a timing belt 18*c* are arranged between the second arm 12 and the second motor 16 and form a second torque transfer path. Torque of the second motor 16 is thus transferred to a base portion of the second arm 12.

In the swing arm mechanism 10 thus constructed, the first arm 11 analogous to the upper arm is swung in mutually reverse directions at a modifiable speed within 360 degrees by the above-described revolving means (refer to the first motor 14) and the second arm 12, analogous to the lower arm axially supported at the free end of the first arm 11, is swung at a modifiable speed by the rotary drive means (refer to the second motor 16). The swing motion of the first arm 11 by the revolving means (refer to the first motor 14) and the swing of the second arm 12 by the rotary drive means (refer to the second motor 16) are independently controlled. For this reason, the movement speeds of the two arms 11 and 12 driven by the revolving means (refer to the first motor 14) and the rotary drive means (refer to the second motor 16) are appropriately variable-speed controlled. A variety of patterns (club turn trajectory) including a motion of a wrist of a model player, such as a wrist turn, are obtained. A variety of test results are obtained in response to the variety of patterns.

In addition to the above-described structure, another independently controlled servomotor serving as twisting means is arranged. The twisting means (servomotor) turns the holder structure 13, arranged on the top surface of the free end of the second arm 12, around the shaft axis of the golf club. A variety of swing patterns is thus implemented.

Figure 4:
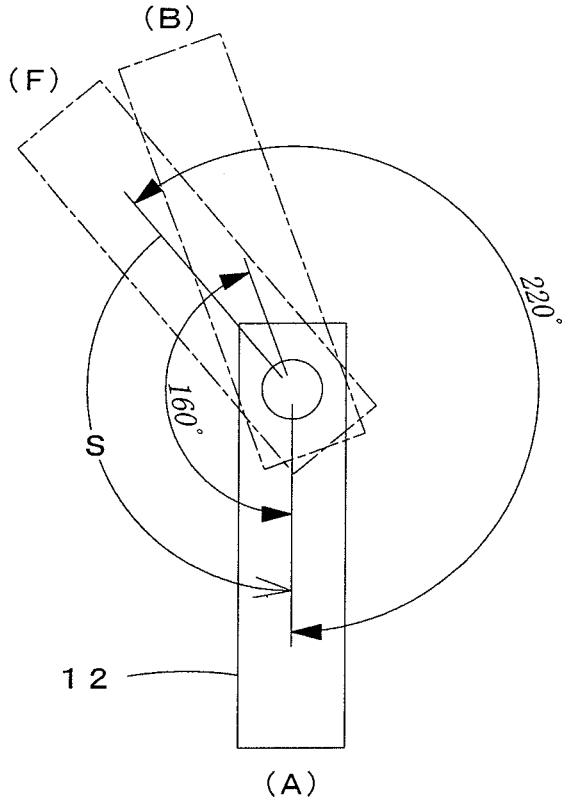
FIG. 4 is a diagrammatic view of rotary trajectory of a first arm of the golf club testing machine.

FIG. 4 diagrammatically illustrates a swing trajectory of the first arm 11 in the swing arm mechanism 10 during a test swing operation. The second arm 12 and the hit assisting mechanism 60, each having an angle of rotation of less than 90 degrees, are not illustrated. After a shot (actual hitting of a golf ball, i.e., a test swing), the motors of the second arm 12 and the hit assisting mechanism 60 are rotated in a reverse direction, causing the second arm 12 and the hit assisting mechanism 60 to reverse-track the trajectory of the shot and return to the original address position. In contrast as illustrated in FIG. 4, during a test swing, the first arm 11 is swung in a reverse direction in a take-back action from an address position (A) to a take-back position (B) at about −160 to −170 degrees and then stops briefly at the take-back position (B). The first arm 11 is then swung in a normal direction, impacts a golf ball at the address position, is rotated from the address position in the follow-through action to a follow-through end position (F) at about +200 to +220 degrees, and then stops there. In the case of a full swing, the follow-through angle may occasionally exceed 230 degrees. Since the golf club testing machine is intended to be used for practical withstand tests, the test swing is typically performed in a full swing fashion. If the first arm 11 is returned to the address position in preparation for a next test swing, the motor needs to rotate in a reverse direction by the angle of rotation from the address position to the follow-through position (200-220 degrees) to reverse-track the trajectory of the test swing.

In accordance with the present invention, the first arm 11 at the follow-through end position (F) subsequent to the shot is made to return to the address position (A) in the normal direction of the shot (as denoted by an arrow S in FIG. 4). In this control method, the first arm 11 is returned to the address position merely by controlling the servomotor of the first arm 11 to rotate the first arm 11 in the normal direction (the test swing direction) by 140-160 degrees. Rather than rotating the servomotor in the reverse direction, the first arm 11 is rotated by one turn in the normal direction. The angle of rotation back to the address position, i.e., a return time is shortened.

This does not necessarily mean that the first arm 11 is always rotated by one turn to revert to the address position. If the angle to the follow-through position is less than 180 degrees, the servomotor may be controlled to rotate in the reverse direction back to the address position.

The second arm 12 and the hit assisting mechanism (barrel section) revert to the address position with the motors thereof rotating in the reverse direction. The angle of rotation of these elements is less than 90 degrees, and these elements are returned to the address position in the reverse rotation more quickly than completing one turn in the normal rotation.

Figure 5:
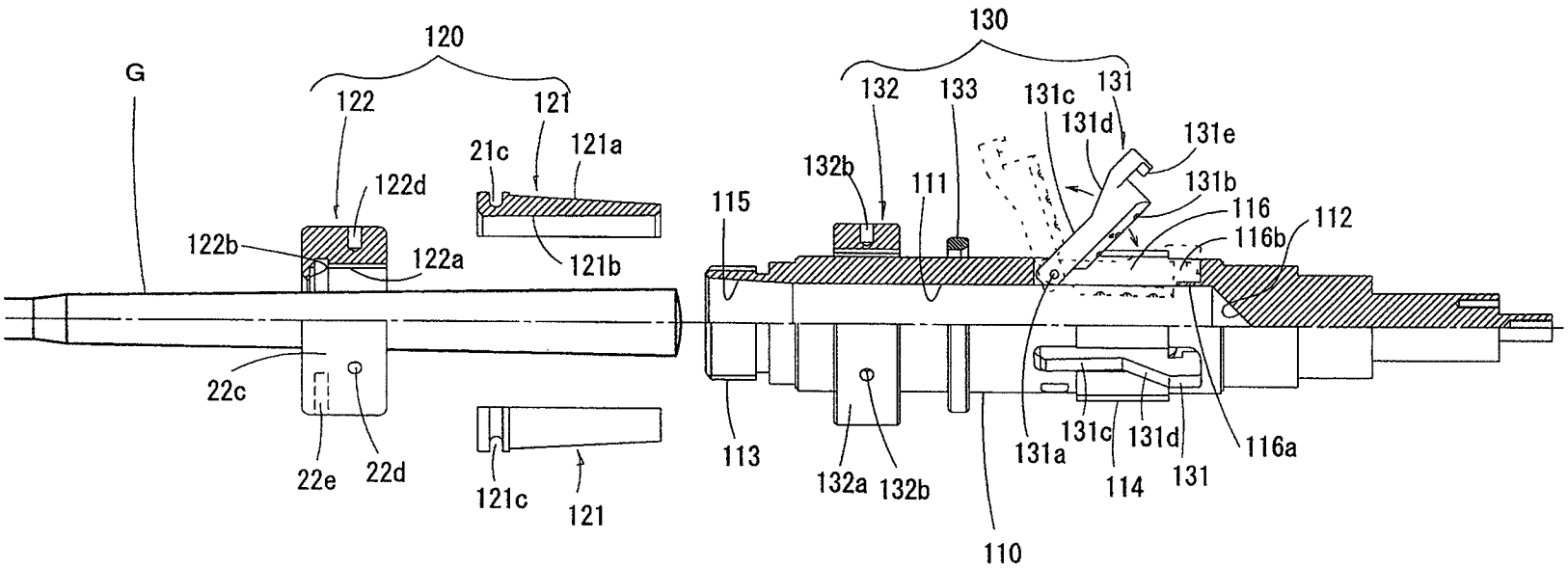
FIG. 5 is an exploded view illustrating a holder structure of one embodiment of the present invention.

The holder structure of the present invention is discussed below. FIG. 5 is an exploded view of the holder structure of the present invention. The holder structure includes a cylindrical body 110, a first chuck arranged at the end portion of the cylindrical body 110, and a second chuck 130 arranged behind the first chuck 120 on the cylindrical body 110.

The cylindrical body 110 is fixed to the second arm 12 of the swing arm mechanism 10 of the golf club testing machine. The cylindrical body 110 includes at the center thereof an insertion hole 111. The insertion hole 111 has a diameter sized to receive a grip G of the golf club, and preferably has a bottom wall 12 at a bottom end thereof to restrict excessive insertion of the grip G.

The cylindrical body 110 has on the external circumference thereof two external screws 113 and 114 at two locations along the longitudinal direction thereof. The external screw 113 on the entry side of the insertion hole 111 is to be engaged with the first chuck 120 and the cylindrical body 110 includes a tapered hole 115 that is formed on the inner circumference of the insertion hole 111 and is tapered toward a deep end from the entry side of the insertion hole 111. The external screw 114 on the rear end portion of the cylindrical body 110 is to be engaged with the second chuck 130. In the area of the external screw 114, elongated slits 116 are arranged at regular angular distances around the circumference of the cylindrical body 110, extend in the longitudinal direction of the cylindrical body 110, and are open to the insertion hole 111. In accordance with the present embodiment, three slits 116 are arranged at 120 degree angular distances around the cylindrical body 110.

The first chuck 120 includes a pair of half-split collet members 121, and a cap nut 122 to be screwed around the entry side external screw 114 of the cylindrical body 110. The collet member 121 has an external tapered curved surface 121*a* that matches, in shape and at inclination angle, the inner circumference of the tapered hole 115 of the cylindrical body 110. The collet member 121 has an inner arc curved surface 121 that matches in shape and at inclination angle the external surface of the grip G. The collet member 121 is thus loaded in a tightly engaged state with the grip G.

The cap nut 122 includes an external screw hole 112*a* to be screwed around the entry side external screw 113 of the cylindrical body 110 and a flange 122*b* formed on one end of the external screw hole 112*a*. If the cap nut 122 is screwed, the flange 122*b* is engaged with the end face of the collet member 121 fixed on the grip G, and the collet member 121 is pushed into the tapered hole 115.

In accordance with the present embodiment, a key hole 122*d* of a hex key wrench W is arranged in the circumference of a barrel 122*c* such that the final tightening operation of the cap nut 122 is performed using the hex key wrench W. In addition to the key hole 122*d*, a through-hole 122*e* is arranged which allows the hex key wrench W to pass therethrough to reach the external screw hole 122*a*. In alignment with the through-hole 122*e*, the collet member 121 includes at the end portion thereof a ring groove 121*c* that is to be engaged with the hex key wrench W.

The second chuck 30 includes jaw members 131 and a nut 132. The jaw member 131 is pivoted at an end 131*a* of the slit 116 of the cylindrical body 110. The jaw member 131 has a toothed surface 131*b* facing the inner surface of the insertion hole 111 and, on the external side opposite the toothed surface 131*b*, a slope surface 131*d* that is continuous from a horizontal surface 131*c* and extends at a rising slope toward the back end of the jaw member 131. With the grip G inserted in the insertion hole 111 in this arrangement, the horizontal surface 131*c* is positioned within the slit 116 and the slope surface 131*d* is projected out of the slit 116.

The nut 132 is screwed around the rear side external screw 114. With the nut 132 tightened, the back end thereof advances toward the slope surface 131*d* of the jaw member 131 and presses the jaw member 131 toward the insertion hole 111 (the grip G). A support ring 133 is arranged between the nut 132 and the jaw member 131 on the cylindrical body 110, and actually presses the jaw member 131 when the nut 132 is tightened. In accordance with the present embodiment, as in the cap nut 122 of the first chuck 120, a key hole 132*b* for the hex key wrench W is arranged in the circumference of a barrel 132*a* of the nut 132. Further in accordance with the present embodiment, a key 131*e* projecting inwardly is arranged on the rear end of the jaw member 131. A socket 116*b* having a bottom 116*a* is arranged on the rear end of the slit 116 to receive the key 131*e*. With the nut 132 tightened, the jaw member 131 is pushed. The pushing motion of the nut 132 against the jaw member 131 is restricted by the key 131*e* engaged with the bottom 116*a* of the socket 116*b*. The excessive pushing of the jaw member 131 is thus prevented.

Figure 6:
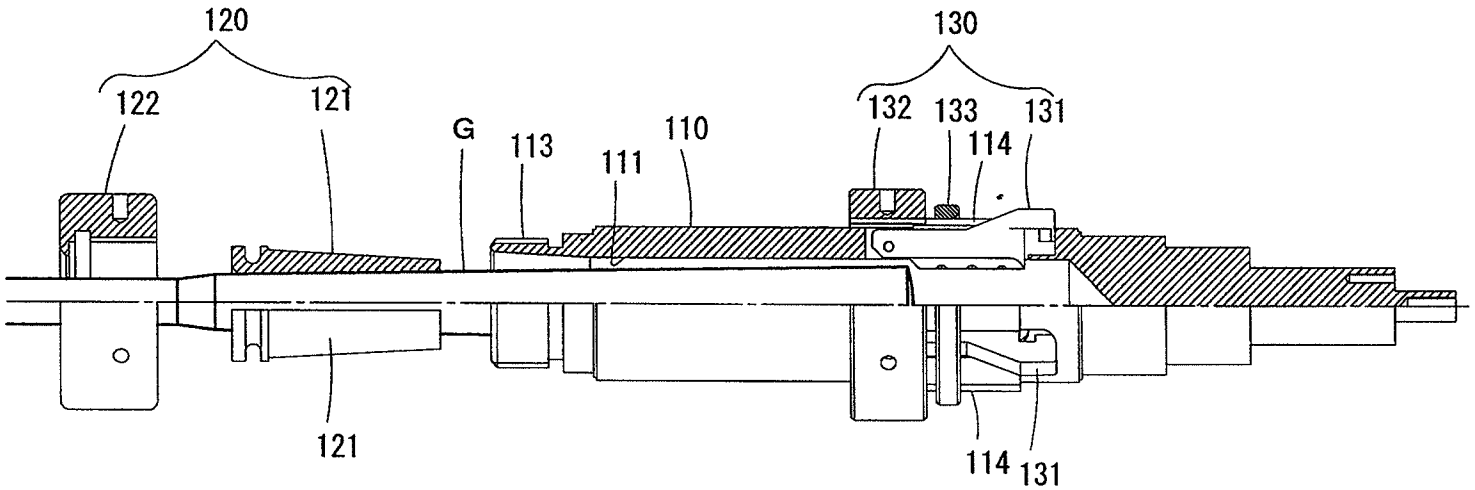
FIG. 6 is a diagram illustrating a preliminary step of the holder structure.

The operation of the holder structure is described below. In a preparatory phase of the operation, the cap nut 122 of the first chuck 120 is set around the grip G as illustrated in FIG. 6. The pair of collet members 121 is set around the grip G with the forward-backward alignment thereof verified. The pair of collet members 121 is set from the proximal end of the grip G with hands. The nut 132 of the second chuck 130 is screwed around the external screw 114 by a short length. In this way, the nut 132 and the support ring 133 are prevented from coming off.

Subsequent to the preparatory phase, the grip G is inserted together with the collet members 121 and 121 into the insertion hole 111 of the cylindrical body 110. The tightening of the cap nut 122 and the nut 132 of the first and second chucks 120 and 130 completes the operation. The cap nut 122 of the first chuck 120 and the nut 132 of the second chuck 130 are tightened in that tightening order. These elements are tightened manually first, and then tightened using the hex key wrench W at the final tightening phase.

Figure 7:
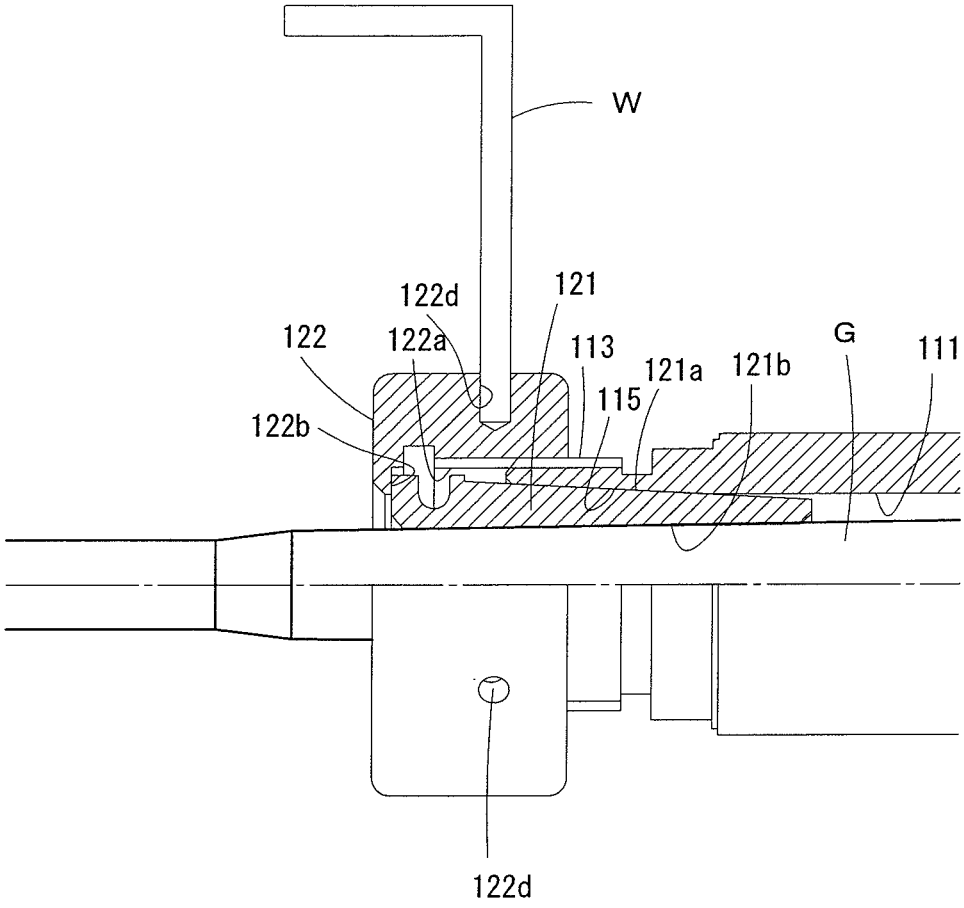
FIG. 7 is a diagram illustrating a final tightening manner of a first chuck of the holder structure.

FIG. 7 illustrates the final tightening manner of the first chuck 120. As the cap nut 122 is tightened, the collet members 121 loaded on the grip G are deeply inserted into the tapered hole 115 of the cylindrical body 110. The degree of grasp of the collet members 121 with the grip G is determined by the depth of insertion. A maximum tightening torque may be controlled by the type of the grip G (size of the grip G and elasticity of a material of the grip G). After the final tightening operation, the cap nut 122 restricts the movement of the collet member 121 in the direction of coming off. Since the external surface and the internal surface of the collet member 121 are in a reverse tapered relationship, the grasping force to the grip G remains unchanged during the test swing. The grip G can be tightly held for a long period of time or through a large number of test swings.

Figure 8:
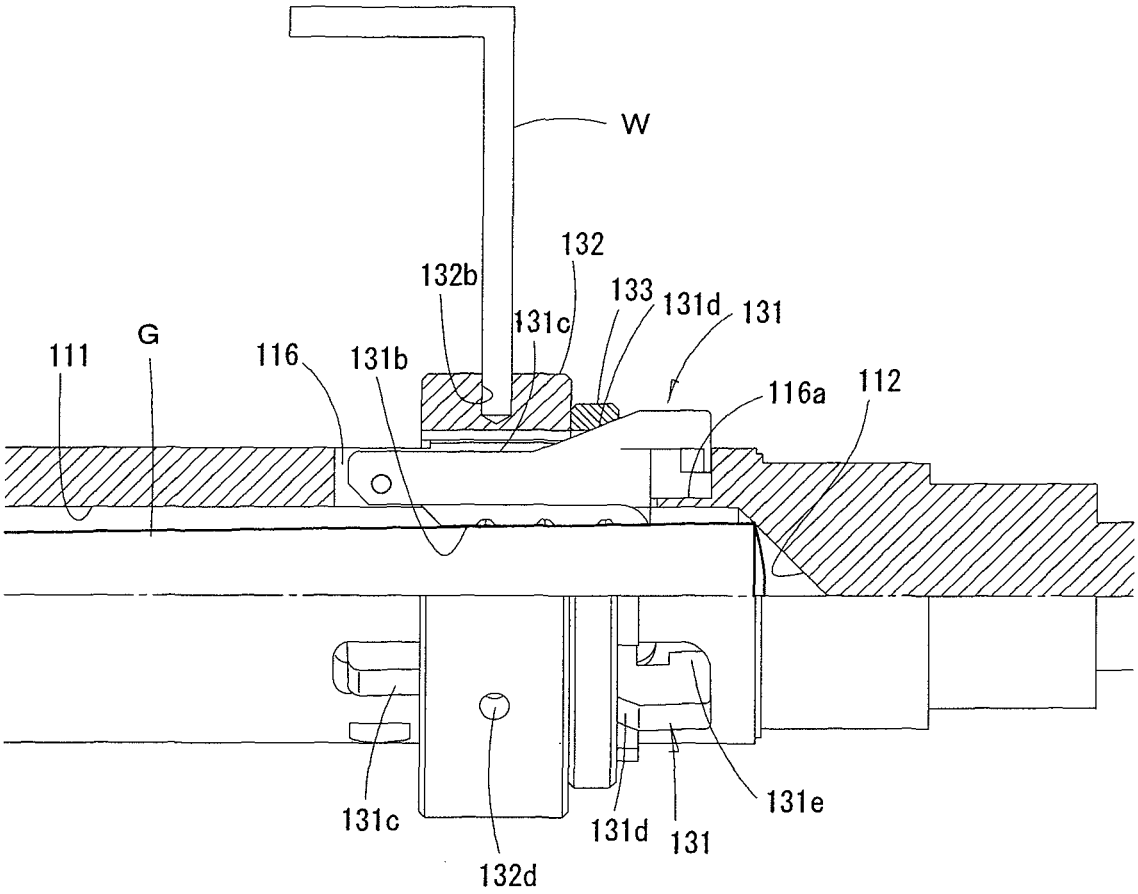
FIG. 8 is a diagram illustrating a final tightening manner of a second chuck of the holder structure.

FIG. 8 illustrates the final tightening manner of the second chuck 130. As the nut 132 is tightened, the nut 132 moves the support ring 133 backward. The support ring 133 advances to the slope surface 131*d* of the jaw member 131. The support ring 133 then strongly presses the slope surface 131*d*, thus pressing the jaw member 131 toward the insertion hole ill. As a result, the grasping force of the toothed surface 131*b* of the jaw member 131 to the grip G is increased. A maximum tightening torque of the nut 132 may also be controlled depending on the type of the grip G.

Figure 9:
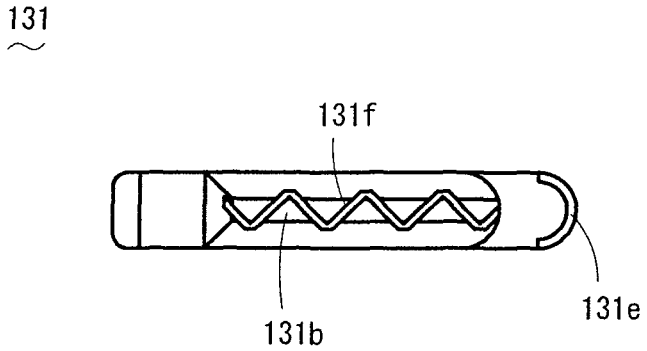
FIG. 9 is a diagram illustrating a toothed surface of a jaw member.

The surface configuration of the toothed surface 131*b* of the jaw member 131 may be rugged. Preferably, as illustrated in FIG. 9, wavy grooves 131*f* are arranged in the axial direction of the grip G. In this case, the wavy grooves 131*f* bite into the surface of the grip G, thereby restricting the motion of the grip G in both the coming off direction and the rotation direction at the same time. The grip G is rigidly held.

In accordance with the holder structure of the present embodiment, the grip G is held at two locations along the longitudinal direction thereof by the first and second chucks 120 and 130. The chucks 120 and 130 exert different grasping manners and different grasping forces to hold the grip G, thereby mechanically simulating the human manner of holding the grip. In the human manner of holding the grip, a human player holds the grip G with both hands at two locations along the longitudinal direction of the grip G with different grasping forces applied on a per hand basis and on a per finger basis. If the holder structure of the present invention is applied to the golf club testing machines disclosed in Application Nos. 07-336153, 08-019176, 2000-202871 and 2005-262515, test results similar to a test swing performed by a human player are thus obtained.

Figure 10:
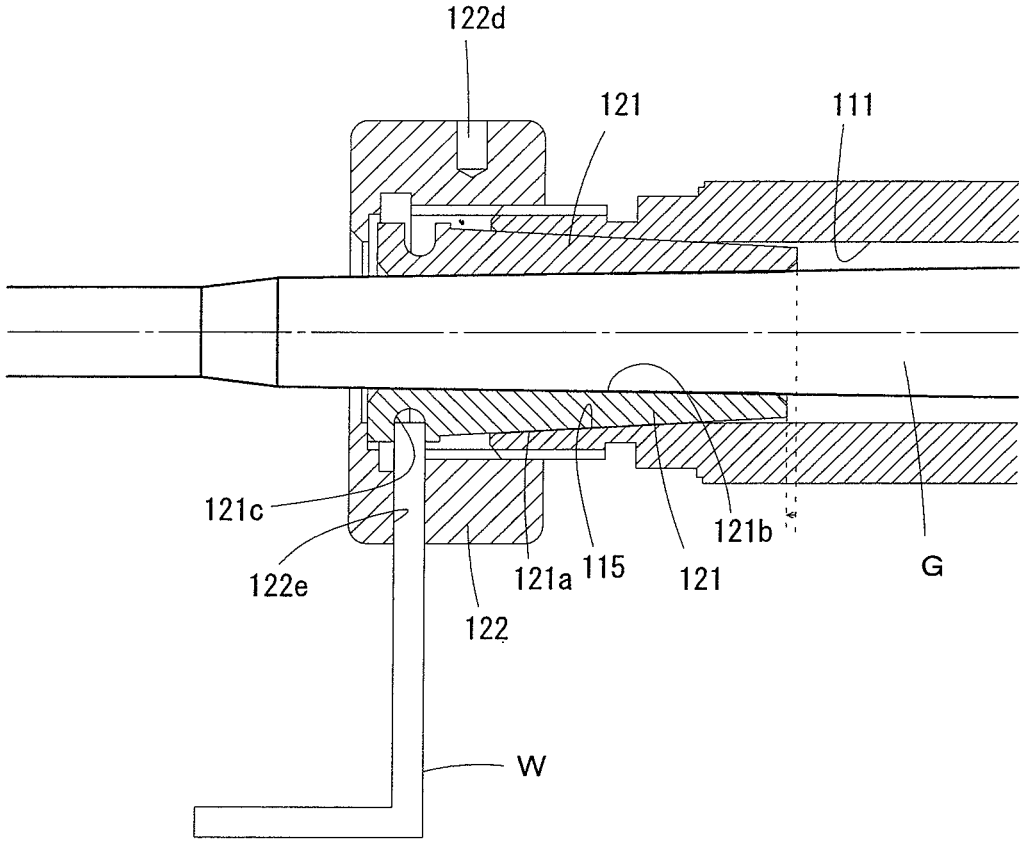
FIG. 10 is a diagram illustrating a disengagement manner of the first chuck.

At the end of a test swing or for replacement of the club, the collet member 121 and the jaw member 131 are released from the engagement to the grip G by simply unloosening the cap nut 122 and the nut 132. If the cap nut 122 is tightened using the wrench, an attempt may be made to remove the cap nut 122 and then to pull manually the collet member 121 out of the tapered hole 151. The collet member 121 may be difficult to pull out of the tapered hole 151 because the collet member 121 is tightly fitted into the tapered hole 115. As illustrated in FIG. 10, the hex key wrench W is inserted through the through-hole 122*e* of the cap nut 122 until the end of the hex key wrench W is received at the ring groove 121*c* of the collet member 121, and then the cap nut 122 is turned in the unloosening direction. In this way, one collet member 121 with the hex key wrench W receiving thereon is moved in the pull-out direction in step with the movement of the cap nut 122. When the one collet member 121 is moved in the pull-out direction, the grasping force of the pair of collet members 121 to the grip G and the insertion force of the pair of collet members 121 sharply weaken. The collet members 121 and 121 are then easily pulled out with hands.

REFERENCE SIGNS LIST

10 Swing arm mechanism
11 First arm
12 Second arm
20 Upper section
30 Barrel section
40 Base section
50 Base foot section
60 Hit assisting mechanism
70 Control unit
G Grip
W Hex key wrench
110 Cylindrical body
111 Insertion hole
113 and 114 External screws
115 Tapered hole
116 Slit
120 First chuck
121 Collet member
121*a* External tapered curved surface
121*b* Inner arc surface
122 Cap nut
122*d* Key hole
122*e* Through-hole
130 Second chuck
131 Movable jaw member
131*b* Toothed surface
131*d* Slope surface
132 Nut
133 Support ring

The invention claimed is:

1. A golf club testing machine, including a first arm rotated by a servomotor, the first arm comprising:

a swing arm mechanism including a second arm having a holder structure of a golf club, the second arm being rotated in unison with the first arm by a motor different from the servomotor, an upper section supporting the swing arm mechanism, a barrel section supporting the upper section in a manner such that the upper section is adjustable at a forwardly inclined angle, a base section supporting the barrel section in a manner such that the barrel section is rotatable in a horizontal plane at a constant height relative to the base section, and a hit assisting mechanism rotating the barrel section in a horizontal plane in unison with the swing arm mechanism.

2. The golf club testing machine according to claim 1, wherein the hit assisting mechanism comprises:

a second servomotor different from the swing arm mechanism, a main gear integrally arranged with the barrel section, and a transfer gear connecting the second servomotor to the main gear.

3. The golf club testing machine according to claim 2, wherein the second arm of the swing arm mechanism and the hit assisting mechanism are controlled in reverse rotation by the different motor and the second servomotor respectively such that the second arm and the hit assisting mechanism reverse a trajectory of a test swing from a follow-through position subsequent to the test swing and return to an address position, and wherein the servomotor of the first arm is controlled in a normal rotation such that the first arm of the swing arm mechanism returns to the address position after rotating by one turn in the same direction as the swing.

4. A golf club holder structure of the golf club testing machine according claim 1, comprising:

a cylindrical body arranged on the second arm of the swing arm mechanism and having at the center thereof an insertion hole receiving a grip of a golf club, and first and second chuck different in structure from each other and arranged at two locations respectively along the longitudinal direction of the cylindrical body.

5. A golf club testing machine, including a first arm rotated by servomotor, the first arm comprising:

a swing arm mechanism including a second arm having a holder structure of a golf club, the second arm being rotated in unison with the first arm by a motor different from the servomotor, an upper section supporting the swing arm mechanism, a barrel section supporting the upper section in a manner such that the upper section is adjustable at a forwardly inclined angle, a base section supporting the barrel section in a manner such that the barrel section is rotatable in a horizontal plane at a constant height, a hit assisting mechanism rotating the barrel section in a horizontal plane in unison with the swing arm mechanism, a cylindrical body arranged on the second arm of the swing arm mechanism and having at the center thereof an insertion hole receiving a grip of a golf club, first and second chuck different in structure from each other and arranged at two locations respectively along the longitudinal direction of the cylindrical body, an external screw arranged on an outer circumference of the cylindrical body on an entry side of the grip insertion hole, and a tapered hole arranged on an inner circumference of the cylindrical body on the entry side of the grip insertion hole and tapered to a rear end of the grip insertion hole, wherein the first chuck includes a plurality of split collet members, each collet member having a tapered outer curved surface at the same inclination as the inclination of the tapered hole and having an inner arc curved surface tightly in contact with the external surface of the grip, and a cap nut screwed around the external screw and causing the collet members into the tapered hole.

6. The golf club holder structure of the golf club testing machine according to claim 5, wherein the cylindrical body comprises:

an external screw arranged on an outer circumference of a rear end portion of the cylindrical body, and a plurality of slits arranged on the outer circumference and the rear end portion of the cylindrical body and communicating with the grip insertion hole, wherein the second chuck includes:

a plurality of jaw members, each jaw member having an end portion thereof pivotally supported to within the slit, having a toothed surface on an inner side thereof facing the insertion hole, and having a rising slope surface on the outer side opposite the inner side, the rising slope surface rising at an inclination toward the rear end thereof, and projected out of the slit, and a nut screwed around the external screw and pressing the slope surface of the jaw member toward the insertion hole.

7. The golf club holder structure of the golf club testing machine according to claim 6, wherein a hex key wrench hole is arranged in the circumference of each of the cap nut and the nut.

8. The golf club holder structure of the golf club testing machine according to claim 7, wherein a through-hole for the hex key wrench, separate from the key hole, is arranged through the barrel of the cap nut to the female hole, and a ring groove is arranged on the outer surface of the collet member to receive the hex key wrench inserted through the through-hole.

9. The golf club holder structure of the golf club testing machine according to claim 8, wherein the collet members include a pair of half-split collet members.

10. The golf club holder structure of the golf club testing machine according to claim 6, wherein the toothed surface of the collet member includes wavy grooves arranged in the longitudinal direction of the grip.

* * * * *